US005499838A

United States Patent [19]

Hauglin et al.

[11] Patent Number: 5,499,838

[45] Date of Patent: Mar. 19, 1996

[54] CROSS-COUNTRY SKI BINDING

[75] Inventors: Bernt-Otto Hauglin, Royken; Rod Johnson, Asker, both of Norway

[73] Assignee: Rottefella AS, Norway

[21] Appl. No.: 151,345

[22] Filed: Nov. 12, 1993

Related U.S. Application Data

[63] Continuation-in-part of Ser. No. 821,007, Jan. 15, 1992, abandoned.

[30] Foreign Application Priority Data

Jan. 17, 1991 [DE] Germany ..... 41 01 273.9
Feb. 1, 1991 [DE] Germany ..... 41 03 068.0

[51] Int. Cl.[6] ..... A63C 9/06

[52] U.S. Cl. ..... 280/615; 280/619; 280/622

[58] Field of Search ..... 280/614, 615, 280/619, 620, 621, 622

[56] References Cited

U.S. PATENT DOCUMENTS

| | | | |
|---|---|---|---|
| 2,181,523 | 11/1939 | Schlytter | 286/611 |
| 3,901,523 | 8/1975 | Burger | 280/611 |

FOREIGN PATENT DOCUMENTS

| | | | |
|---|---|---|---|
| 0287143 | 1/1967 | Australia | 280/620 |
| 0153381 | 5/1938 | Austria | 280/619 |
| 0154171 | 9/1938 | Austria | 280/619 |
| 756374 | 12/1933 | France . | |
| 801546 | 4/1936 | France . | |
| 603854 | 10/1934 | Germany . | |
| 803152 | 3/1951 | Germany . | |
| 853405 | 10/1952 | Germany . | |
| 1478156 | 5/1970 | Germany . | |
| 2364001 | 5/1975 | Germany . | |
| 2630770 | 2/1977 | Germany . | |
| 2400614 | 3/1979 | Germany . | |
| 2846914 | 4/1980 | Germany . | |
| 3539315 | 9/1986 | Germany . | |
| 194783 | 12/1937 | Switzerland . | |

*Primary Examiner*—Brian L. Johnson
*Attorney, Agent, or Firm*—Andrus, Sceales, Starke & Sawall

[57] ABSTRACT

A cross-country ski binding, especially a hiking ski binding which includes a toe iron (10) adapted for mounting on a ski top and having cheeks (11) and sole catches (12) for accommodating and supporting the front part of the sole of a ski booth in sideways, forwards and upwards directions. A tension cable (14) is adapted to be passed about the heel of the boot and includes a tensioning mechanism (13) whereby the ski boot may be fixed to the toe iron (10) such that during cross-country skiing or ski hiking, the heel of the boot and the heel of the skier may be raised from the ski top. The tension cable (14) also co-operates with a mechanism (15) for varying the effective cable length. A portion of the tension cable (14) includes a tension spring (16, 17). A tightening lever (19) bearing against the sole of the boot is pivotally mounted on the portion (18) of the tension cable (14) which is intended to be passed about the heel of the boot. The pivot (20) for lever (14) extends parallel to the tension cable (14, 18). Various embodiments are shown including one having a single lever member and others having first and second lever members pivotally interconnected to each other.

4 Claims, 9 Drawing Sheets

27
26
29
30
III
31
14
28
III
28
31
14
32

19
22
13
21
33
16
28
31
30
29
26
27
14
20
18
33
23
17
25
15
24
34
11
10
12
14
11
12
34

CROSS-COUNTRY SKI BINDING

This application is a continuation-in-part of Ser. No. 07/821,007 filed Jan. 15, 1992, now abandoned.

BACKGROUND OF THE INVENTION

The invention is directed to a cross-country ski binding, especially a hiking ski including a Telemark binding. The binding includes a toe iron adapted to be mounted on the top of a ski. The toe iron includes cheeks and sole catches for accommodating and supporting the front part of the sole of a ski boot on the sides, front anal upper portions. A tension cable is adapted to be passed around the heel of the boot anal coupled to a tensioning mechanism for fixing the ski boot to the toe iron such that during cross-country skiing the boot heel and the heel of the skier's foot may be raised from the ski top. The tension cable has part replaced by a tension spring, and which co-operate for varying the effective cable length.

Such a binding has been known in which the tension spring is passed around the boot heel in the case of the known binding. A tensioning mechanism comprises a tightening lever which is disposed sideways with a mechanism. Means for varying the length of the tension cable, which mechanism comprises a screw bolt and a co-operating nut is provided between the lever mechanism and the tension spring.

The known binding has proven highly satisfactory for cross-country or touring skis. However, the arrangement anal configuration of the tensioning mechanism exhibits a certain drawback. Due to its low position just above the ski top, the mechanism is not readily accessible, above all in case of deep snow.

Furthermore, it is necessary with the known binding to adapt the heel of the boot to the tension spring which is to be passed thereabout, for instance in the form of a groove formed on the heel in which the tension spring must be placed before the binding can be locked.

SUMMARY OF THE PRESENT INVENTION

It is the object of the present invention to provide a further development of the known binding or a binding of the above-described kind in such a way that handling thereof is facilitated while not requiring any additional design efforts.

In accordance with the invention, the specified object is solved by a tightening lever adapted to bear against the boot sole and which is pivotally mounted on the portion of the tension cable adapted to be passed about the heel. The pivot axis of the lever extends parallel to the tension cable.

Due to the tightening lever which is disposed and designed in accordance with the invention, it is extremely easy to close and open the binding. The tightening or closing mechanism is readily accessible to the cross-country skier from the top. Due to the fact that the tightening lever is moved in a vertical place it is considerably easier to apply the required torque than with a conventional tightening lever which is pivoted in a horizontal plane. Also, the boot sole need not be specially designed in the area of the heel of the ski boot. It will be sufficient for the boot sole to protrude slightly beyond the leg of the boot. The tightening lever may then bear against the protruding portion of the boot sole.

It is preferred that the tightening lever should be approximately L-shaped, wherein the one, shorter, arm of the L is adapted to bear against the sole portion which protrudes rearwards beyond the upper or to bear against a recess formed in the sole, while the other, preferably the longer, arm is used as an actuating member.

It is preferred that the swiveling axis of the tightening lever should be in the corner area between the two above-mentioned arms.

When the portion of the tension cable which is to be passed about the boot heel is configured as a solid, relatively rigid wire bracket or the like, this portion is simultaneously used as a swivel axis for the tightening lever so that the corresponding design is extremely simple. No separate components are required for the swivel mounting of the tightening lever.

It is preferred that the above-mentioned wire bracket should be connected to the remainder of the tension cable by means of tension springs in such a way that said springs each form part of the two side portions of the tension cable. Basically, it would be conceivable to provide only a single tension spring as an integral part of the inner or outer side portion of the tension cable. It is, however, preferred that two tension springs should act on either side of the ski boot.

In a concrete embodiment, at least one tension spring is rotatably connected to the co-operating end of the wire bracket, the opposite end comprising an internally threaded portion into which a screw bolt may be threaded to a greater or lesser depth, said screw bolt being connected to the associated connecting end of the tension cable. Instead of a separate internally threaded portion, it is also possible to provide the bolt with threads adapted to be screwed into the spirals of the tension spring. In the first-mentioned-embodiment, the internally threaded portion is connected to the tension spring in the specified way, i.e. it has external threads adapted to be screwed into the coils of the tension spring. However, any other way of mounting the internally threaded portion to the tension spring is conceivable, for example, by brazing or the like.

The other tension spring may be connected to the tension cable in the same way as the aforementioned tension spring. Since it is, however, unnecessary to provide two means for varying the length of the tension cable, it is preferred that the other tension spring should be adapted to be connected to the tension cable by way of a connecting piece of the respective connecting end of the tension cable which can be screwed into the spirals of the spring. This connecting end of the tension cable is preferably formed with an enlargement over which the connecting piece and optionally at least a spacer sleeve may be fitted on the tension cable wherein —if provided—the spacer sleeve and the connecting piece are retained on the connecting end of the tension cable by means of a retaining washer or the like which is pushed sideways over the cable in front of the enlargement. The retaining washer may be configured so as to include a lateral notch having a width corresponding to the diameter of the tension cable and smaller than the diameter of the end-side cable enlargement. In this way, the connecting piece and the spacer sleeve are securely retained on the mentioned end of the tension cable. Furthermore, the spacer sleeve, the retaining washer and the enlargement at the free end of the tension cable are dimensioned such that all of the aforementioned parts can be accommodated within the co-operating tension spring.

In another embodiment, the tightening lever is pivotally mounted on a swivel arm which is in turn pivotally mounted on the tension cable, viz. that part of the cable which will be passed about the heel of the boot, wherein the swivel axis of the tightening lever extends in parallel with the swivel axis of the swivel arm. Due to this tightening lever arranged and configured in accordance with the invention, manipulation of the binding upon closing and opening is additionally facilitated. The arrangement creates a further degree of freedom and the tightening lever may be moved particularly well and rapidly to the respective proper position.

The tightening lever bears against the swivel arm under the action of a resilient bias, whereby any automatic loosening of the tightening lever is sufficiently counter-acted. In an advantageous improvement of the invention, an adjusting screw is provided which passes through the tightening lever in the longitudinal direction thereof, a compression spring and particularly a helical compression spring being disposed between the head of said adjusting screw and the tightening lever. In accordance with the invention, the adjusting screw is adapted to be screwed transversely into a supporting pin which extends on the swivel arm in parallel to the swivel axis of the tightening lever and is rotatably mounted in the swivel arm. By means of this adjusting screw, the bias may be varied extremely accurately and without any effort. Also, this embodiment of the invention offers the advantage that the bias between ski boot and binding is freely selectable and readjustable without any difficulty even after the binding has been tightened or closed.

Additionally, the binding according to the invention is very easily manipulated due to the fact that the head of the adjusting screw is configured as an actuating element, especially as a square.

Due to the fact that the swivel axis of the tightening lever in the closed position of the binding is nearer the heel of the boot than the supporting bolt which accommodates the adjusting screw, reliable mounting of the ski boot in the binding is ensured. Consequently, any automatic opening of the binding without additional external action is precluded.

Furthermore, it is within the scope of the invention to pass the tension cable through a slot formed in the tightening lever or swivel arm, wherein the slot extends, as viewed from the side, from the top rear to the bottom front and a resilient element, especially a spring element, is disposed within the slot by means of which the tension cable is biased or urged towards a top rear position. The slot includes an angle with the vertical of preferably about 15° to 25°. This structural measure further facilitates releasing of the tightening lever and hence opening of the binding upon corresponding external action, i.e. pivoting of the tightening lever or the tensioning mechanism by the cross-country skier.

According to another embodiment of the invention, the tensioning mechanism comprises a tightening lever which is disposed in front of the toe iron and movable in a vertical plane to act on the tension cable, said tightening lever in the tightened or closed position of the binding adopting an over-center position. The advantageous design of this binding according to the invention resides in the additional function of the toe iron as a support for the rotatable tightening lever. This alternative design allows for different manipulation of the binding during closing and opening. Consequently, the binding in accordance with the one embodiment is actuated by a swiveling movement of the tightening lever whereas in the alternative embodiment it is actuated by a substantially lifting or lowering movement which is on a longitudinal movement of the tightening lever. Thus, the cross-country skier is offered several possible ways of closing and opening a binding.

Finally, in respect of a sufficient tightening effect, it is very important in accordance with the invention that at least two arcuate grooves are formed either in front of the toe iron or on the frontside tensioning mechanism. The tensioning cable can be placed into these grooves or locked therein from above with a corresponding coarse adjustment of the effective length of the tension cable, whereas the fine adjustment of the effective length of the tension cable is effected with the tensioning mechanism in accordance with the invention.

In order to allow easy matching of the binding with the respective ski boot size, the arcuate grooves are formed in a separate plastic member or the like and can be severed therefrom as desired or required in the necessary numbers prior to mounting on the ski top. Simultaneously, this offers the advantage of simplified manufacture of such grooves which are provided for coarse adjustment of the effective tension cable length.

BRIEF DESCRIPTION OF THE DRAWINGS

Below, several embodiments of a cross-country ski binding configured in accordance with the invention are explained in detail with reference to the accompanying drawing, in which.

DESCRIPTION OF THE ILLUSTRATED EMBODIMENT

Figures 1, 2, 3:
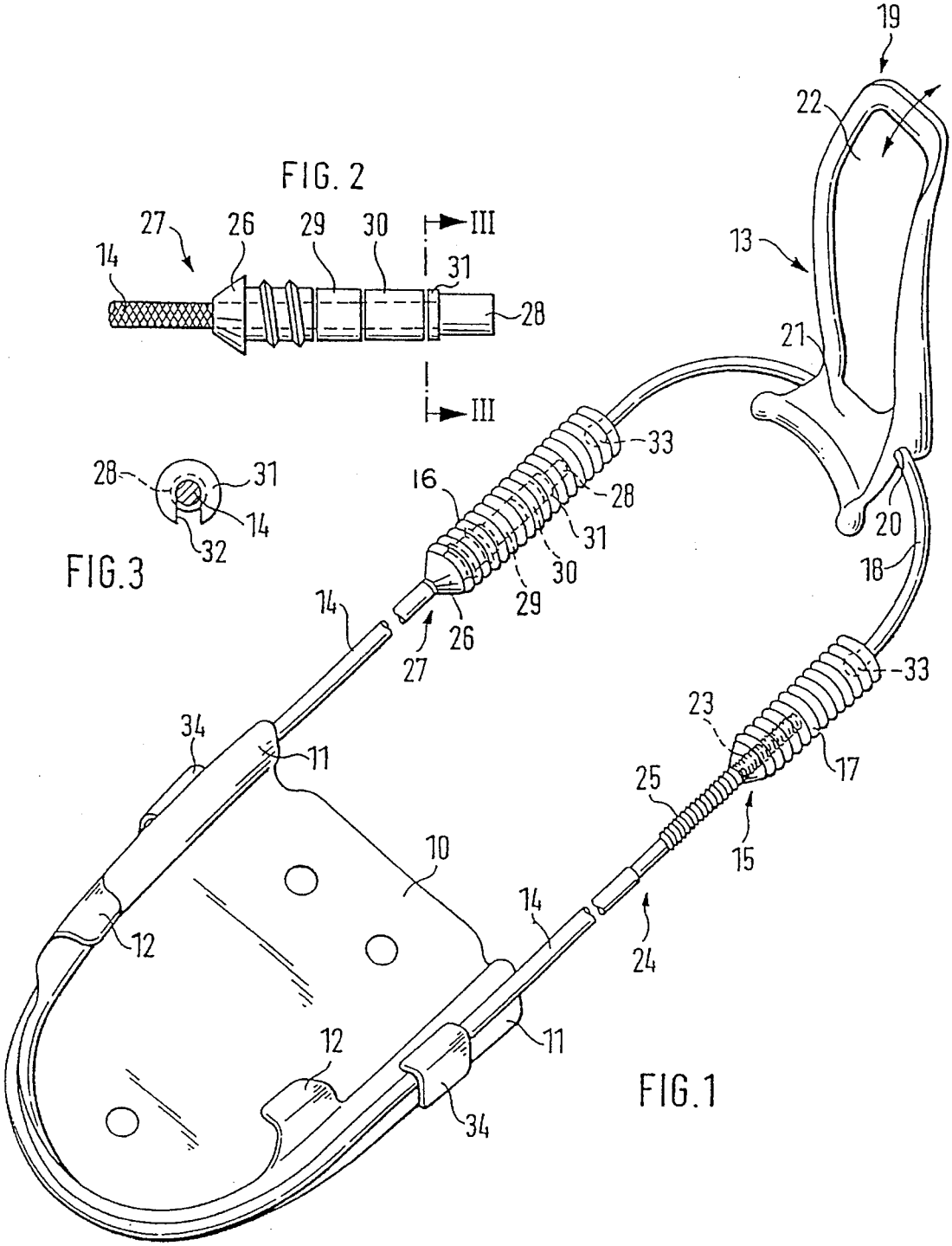
FIG. 1 is a schematic/perspective view of a cross-country ski binding in accordance with the invention.
FIG. 2 is a side view of a detail of the binding shown in FIG. 1.
FIG. 3 is a sectional view along the line III—III of FIG. 2.

The cross-country ski binding shown in FIG. 1 comprises a toe iron 10 for mounting on the top of a ski and having two cheeks 11 and sole catches 12 for accommodating and supporting the front part of the sole of a ski boot sideways, forwards and upwards. This component is known per se so that it need not be described in detail. Further, the cross-country ski binding illustrated in FIG. 1 comprises a tension cable 14 which may be passed about the heel of the boot and is coupled to a tensioning mechanism 13 for fixing the ski boot (not illustrated) to the toe iron such that during cross-country skiing or ski hiking the ski boot heel or the heel of the skier may be raised from the ski top. The tension cable 14 also co-operates with a mechanism for varying its effective length. This means is identified at 15 in FIG. 1. Also, the tension cable 14 includes two tension springs 16 and 17 each of which is a helical tension spring.

The tensioning mechanism 13 is constituted by a tightening lever 19 which is pivotally mounted on the part 18 of the tension cable which is passed around the boot heel and bears against the boot sole in the tightening position. The swivel axis 20 of the tightening lever 19 extends in parallel to the tension cable 14 or 18, respectively. In the instant case, the part 18 of the tension cable 14 which is to be passed around the boot heel is a solid, relatively rigid wire bracket which simultaneously forms the swivel axis for the tightening lever 19. The tightening lever 19 is approximately L-shaped and the one, shorter, arm 21 thereof is adapted to bear against the non-illustrated boot sole, especially against the sole portion thereof which protrudes rearwards beyond the upper or leg of the boot or against a recess formed in the boot sole, whereas the other, longer, arm 22 is used as an actuating member by the cross-country skier. As will be apparent from FIG. 1, the aforementioned tightening lever 19 is mounted for swivelling movement about the wire bracket 18 in the corner region between the two arms 21 and 22. In the closed state, the tightening lever 19 adopts an over-center position relative to the swivel axis 20.

The wire bracket 18 is connected to the remainder of the tension cable 14 by way of the two aforementioned tension springs 16 and 17 in such a way that the tension springs 16 and 17 each form part of the two side portions of the tension cable 14. The one tension spring 17 is rotatably connected to the respective end of the wire bracket 18, wherein the opposite end comprises an internally threaded portion 23 into which a screw bolt 25 connected to the respective connecting end 24 of the tension cable 14 can be screwed to a greater or lesser depth. The length of the tension cable 14 may thereby be varied.

The other tension spring 16 is adapted to be connected to the tension cable 14 by way of a connecting piece 26 of the respective connecting end 27 of the tension cable, said connecting piece being adapted to be screwed into the coils of the spring. As will be apparent from FIG. 2, the connecting end 27 of the tension cable 14 is formed with an enlargement 28 over which the connecting piece 26 as well as two spacer sleeves 29, 30 of plastic material can be fitted onto the tension cable 14. The spacer sleeves 29, 30 and the connecting piece 26 are retained on the tension cable 14 at the connecting end 27 thereof by a retaining washer 31 which is pushed sideways onto the tension cable 14 between the spacer sleeve 30 and the enlargement 28 to form a stop unit at the end of cable 14. According to FIG. 3, the retaining washer 31 has a lateral cut-out 32 whose width corresponds to the diameter of the tension cable 14 and is smaller than the diameter of the end-side cable enlargement 28.

Figure 3A:
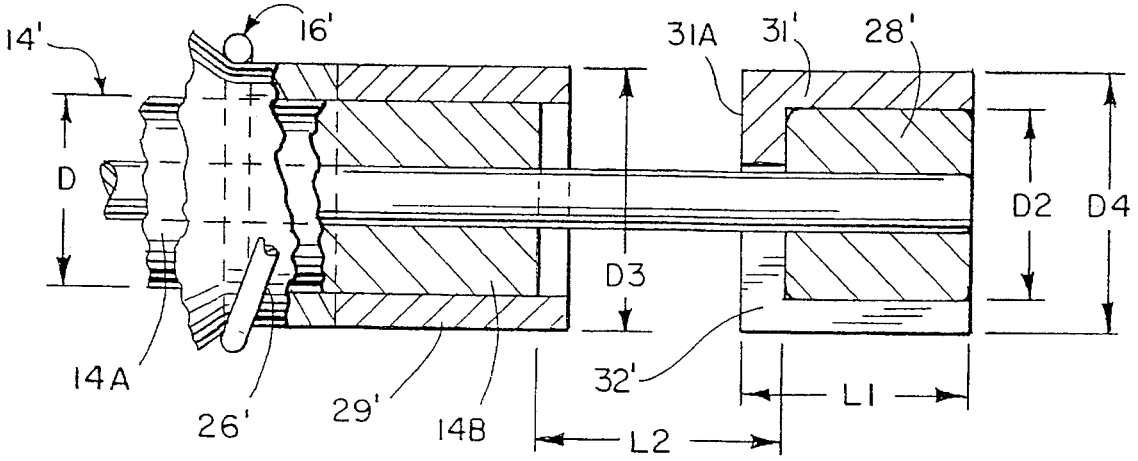
FIG. 3*a* is a view similar to FIG. 2.
Figure 3B:
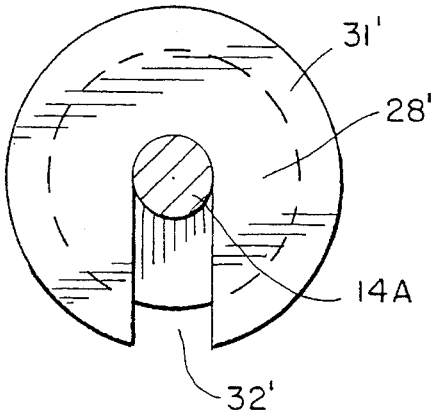
FIG. 3*b* is a view similar to FIG. 3.

A preferred construction of the length adjustment unit is shown in FIGS. 3A and 3B, in which elements corresponding to the elements of FIGS. 2 and 3 are correspondingly identified by primed numbers.

As shown in FIGS. 3A and 3B, the tension cable 14' is shown as a coated cable having an inner core 14A and an outer coating or cover. The core 14A is shown as a solid member of wire or other suitable high strength material and the coating or cover 14B is a suitable covering material. The connecting piece 26' is mounted on the tension cable 14'. The cable 14' projects through the piece 26', which is suitably affixed to the spring 16' in any suitable manner and preferably by the illustrated threaded attachment.

The projected cable 14' defines a stepped end with an outer diameter D and with the core 14A projecting through the tension spring 16' with a smaller diameter. The end enlargement 28' is shown as a separate member affixed to the core 14A and preferably the end thereof as by an adhesive, a pinned connection or other suitable unit. The enlargement 28' has a diameter D2 which is no greater than D and preferably substantially equal thereto. The enlargement 28' is spaced from the stepped end of the tension cable 14' by a distance L2 which is equal to or greater than the length L1 of the enlargement 28'.

The retaining washer 31' is a tubular member having slotted end wall 31A. The slot 32' related to the wire core 14A and of a depth such that the inner or base is located within the stepped end of the cable and the enlargement 28'. The washer 31' in a maximum setting fits over the enlargement 28', as shown in FIGS. 3A and 3B. The length of the washer 31' is shown substantially fitting over the enlargement in the illustrated embodiment.

One or more spacer sleeves, only one sleeve 29' shown, are also preferably provided for sliding placement on the projecting end of cable 14'. The sleeves have a diameter D3 essentially the same as the diameter D4 of the outer or end enlargement 28'.

The sleeves are tubular members having a diameter D3 substantially equal to the diameter D4 of the retaining washer 31' and internal diameter to fit over the cable 14' for location between the enlargement 28' and the washer 31' or outwardly of the washer 31', generally as in the previous embodiment. Thus, the outer diameter D4 of the washer and the outer diameter of sleeve 29' are substantially the same.

The length of the gap L2 between the stepped wire end and the length L1 of retaining washer are related such that L1 is preferably equal to or less than L2.

Basically, it would also be conceivable to configure the connection between the wire bracket 18 and the tension cable 14 in the vicinity of the tension spring 16 similar to the connection in the vicinity of the tension spring 17. For the rest, both free ends of the wire bracket 18 are provided with enlargements 33 through which the two tension springs 16 and 17 are retained on the ends of the wire bracket in such a way as to be rotatable about their longitudinal axes.

The tension cable 14 is slung about the toe iron 10. Externally, it is held on the two cheeks 11 of the toe iron 10 by means of angle lugs 34 mounted on the sides. The front end of the toe iron 10 is provided with indentations (not illustrated in FIG. 1) in which the tension cable 14 is held in such a way that in use it cannot easily slip upwards over the front edge of the toe iron.

The illustrated and described binding is especially suitable for cross-country skis; it may also be used as a so-called Telemark binding.

The described binding is both easy to handle and of simple structure. This applies particularly to the connection between the tension cable 14, on the one hand, and the tension springs 16, 17, on the other hand. The tensioning mechanism 13 is also easy to manufacture and reliable during handling and use. The freedom of movement is not limited thereby in any way. The ski boot also does not require any special provisions for the tightening lever 19, provided the sole of the boot protrudes slightly rearwardly beyond the leg of the boot.

All of the features disclosed in the present application papers are claimed as being essential to the invention insofar as they are novel over the prior art both individually and in combination.

Figure 4:
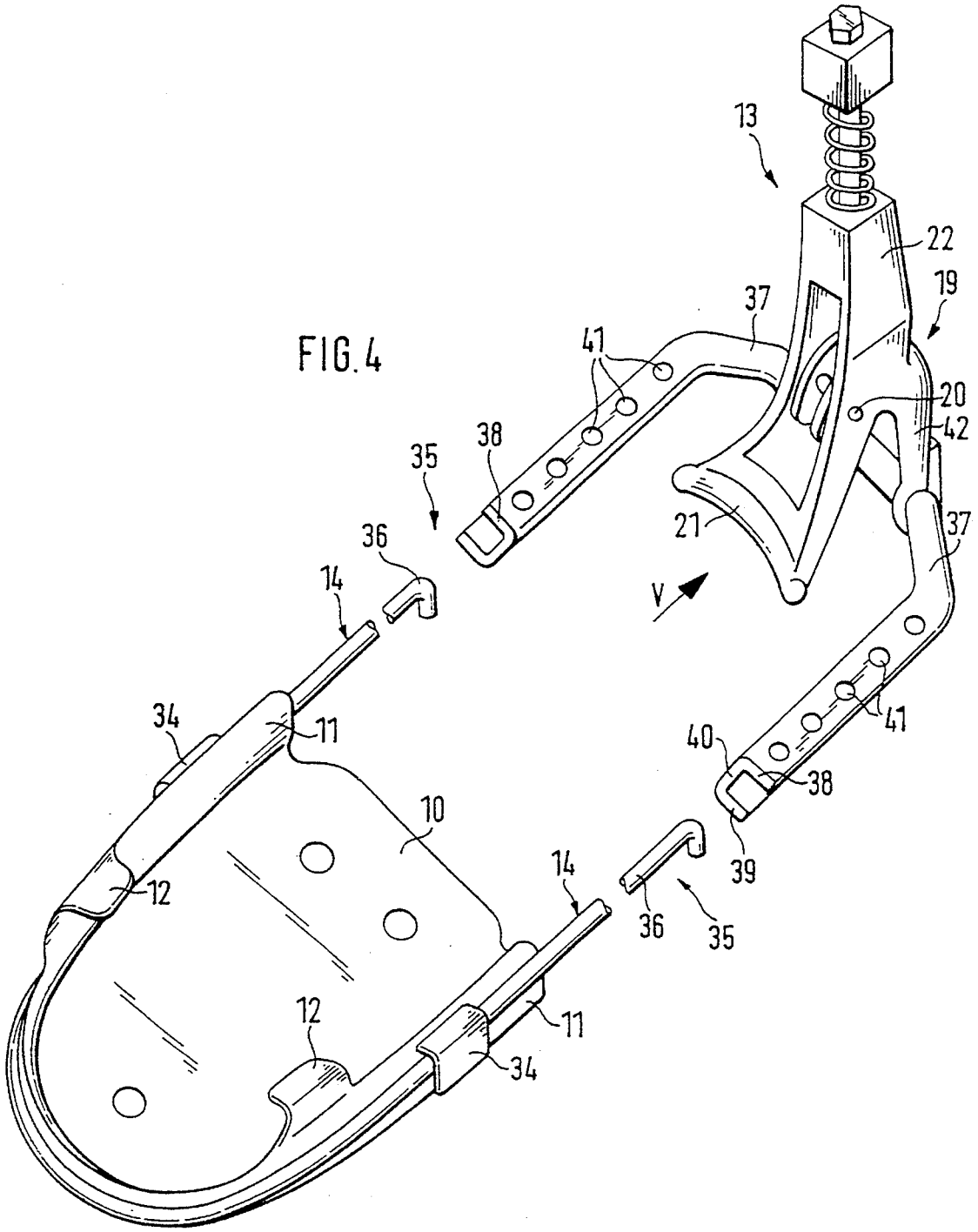
FIG. 4 is a schematic/perspective view of a further cross-country ski binding in accordance with the invention.

The embodiment of the cross-country ski binding shown in FIG. 4 corresponds to the cross-country ski binding shown in FIG. 1 in respect of the toe iron 10 which is to be mounted on a ski top. Each of the two connecting ends 35 of the tension cable 14 is provided with an L-shaped connecting piece 36, wherein the one, slightly longer, arm of each connecting piece 36 immediately adjoins the associated connecting end 35 of the tension cable 14. The other, shorter, arm of the respective connecting piece 36 extends vertically and is provided for anchoring the tension cable 14 to a substantially rigid member 37 which can be passed about the heel of the boot.

The member 37, which is approximately U-shaped in plan view, has C-cross-section, wherein the central leg 40 which interconnects the upper and the lower legs 38, 39 faces the non-illustrated ski boot. In this respect, the C-cross-section member 37 is open to the outside, i.e. away from the non-illustrated ski boot.

Each of the upper and lower legs 38, 39 of the member 37 is provided with a multiplicity of regularly spaced through-holes 41. The diameter of these through-holes 41 is selected to be slightly larger than the diameter of the shorter arm of the connecting piece 36 so that said shorter arm may be inserted sideways between upper and lower leg 38, 39 of the member 37 into the correspondingly chosen through-hole 41. In the tightened or closed position of the binding, the tension cable 14 together with the connecting piece 36 is guided by the C-cross-section member 37 along the upper and lower legs 38, 39 and the central leg 30 in close engagement therewith. In this respect, the tension cable 14 is captively connected to the member 37 to be passed about the heel of the boot, whereby its effective length is correspondingly coarsely adjusted.

The tensioning mechanism 13 of FIG. 4 includes a tightening lever 19 mounted for swivel movement about a swivel arm 42. The swivel arm 42 is in turn rotatably mounted on the tension cable 14 at the part 37 thereof which is intended to be passed around the heel of the boot. The swivel axis 20 of the tightening lever 19 extends in parallel with the swivel axis 43 of the swivel arm 42. The tightening lever 19 is of approximately L-configuration, in which the one, shorter, arm 21 is adapted to bear against the ski boot (not illustrated) whereas the other, longer, arm 22 is used as actuating member by the cross-country skier.

Figure 6:
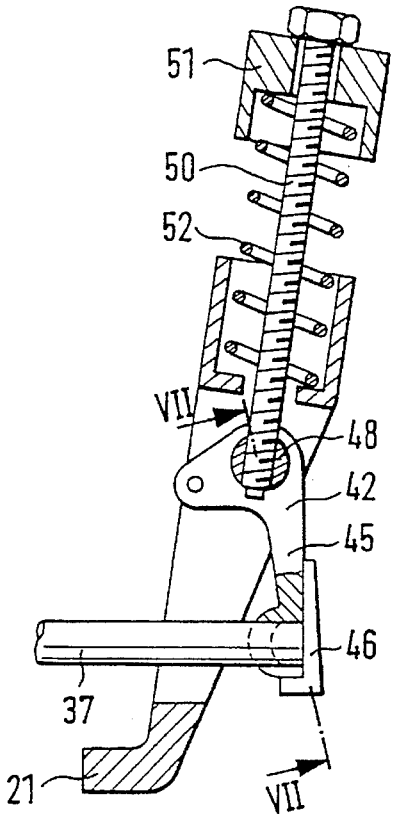
FIG. 6 is a partial longitudinal section of the tensioning mechanism according to the invention illustrated in FIG. 5 along the line VI—VI.
Figure 7:
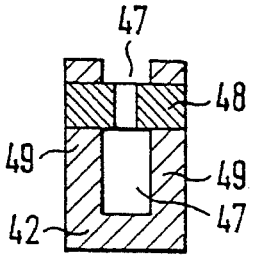
FIG. 7 is a longitudinal section through a detail of the binding shown in FIG. 6 along the line VII—VII.

As illustrated in FIGS. 4, 6 and 7, the swivel arm 42 is likewise approximately L-shaped. The one, shorter, leg 44 of the swivel arm 42 is pivoted to the tightening lever 19 through the pivot 20 which is a bolt or the like. The longer leg 45 of the swivel arm 42 is rotatably connected to the tension cable 14 or the part 37 which is intended to be passed around the boot heel via the swivel axis 43. A locking plate 46 or the like, which may be screwed to the longer leg 45, provides for the captive state of the tension cable 14 or part 37 pivoted to the swivel arm 42.

As shown in FIG. 7, the swivel arm 42 is bifurcated due to a recess in the form of a slot 47 in the vicinity of the shorter leg 44, the corner region between the shorter and the longer legs 44, 45 and a portion of the longer leg 45. Furthermore, in the corner region of the swivel arm 42, there is provided a supporting bolt 48 which is rotatably mounted in the two side portions 49 of the swivel arm 42 formed by the slot 47 to interconnect these two side portions. The supporting bolt 48 extends in parallel to the swivel axis 20 of the tightening lever 19 and to the swivel axis 43 of the swivel arm 42.

Figure 5:
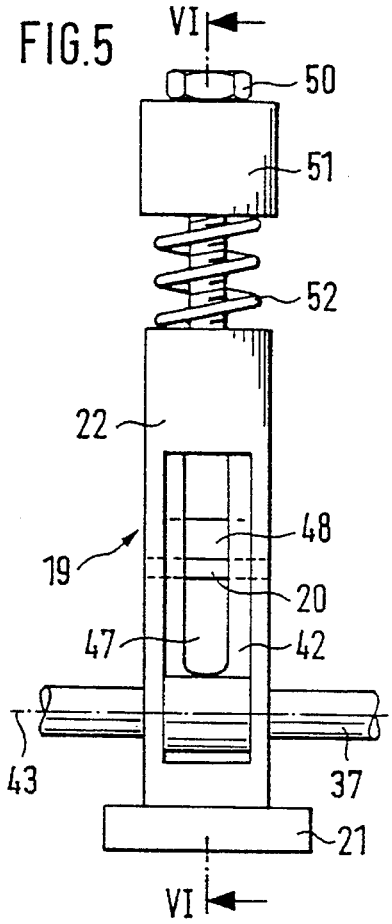
FIG. 5 is a partially cut-off, enlarged front view of a tensioning mechanism configured in accordance with the invention as seen in the direction of the arrow V of FIG. 4.

As illustrated in FIGS. 4 to 6, an adjusting screw 50 may be screwed transversely into the rotatably mounted supporting bolt 48 to extend through the tightening lever 19 in the longitudinal direction thereof, a compression spring in the form of a helical compression spring 52 being disposed between the head 51 of the adjusting screw and the tightening lever 19. The head 51 of the adjusting screw 50, which is configured as a square, serves simultaneously as actuating member for fine-adjusting the bias by the tensioning mechanism 13, because the bias between tightening lever 19 and swivel arm 42 is determined by actuation of the adjusting screw 50. In the tightened or closed position of the binding, the swivel axis 20 of the tightening lever 19 is nearer the heel of the boot than the supporting bolt 48 which accommodates the adjusting screw 50.

Figure 8:
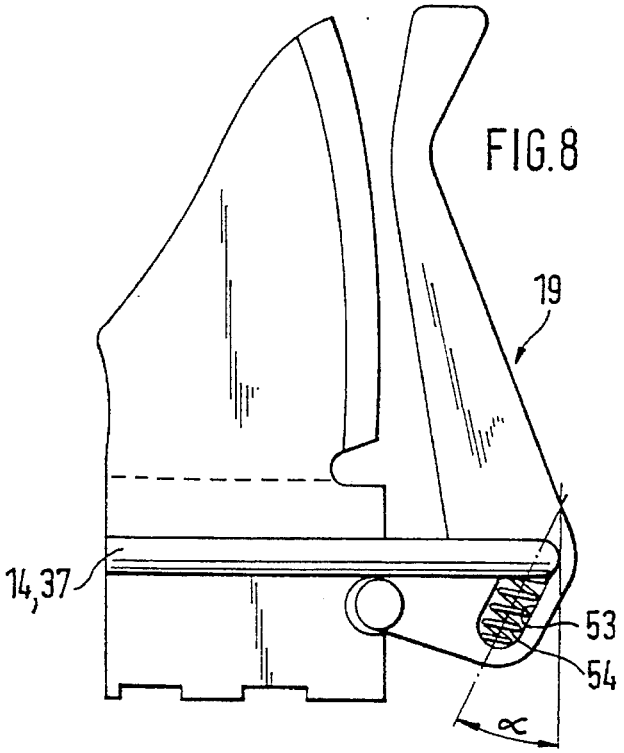
FIG. 8 is a schematic side view of another embodiment of a tensioning mechanism according to the invention in combination with ski boot and tension cable partially broken away.

According to FIG. 8, the tightening lever 19 is slightly modified as compared with the afore-described embodiments. Here, the tension cable 14 extends through a slot 53 in the tightening lever 19 (or the swivel arm 42), said slot running from the top rear to the bottom front as viewed from the side. A resilient element acts on or biases the tension cable 14 within the slot 53. In the present case, the tension cable 14 is urged by a spring 54 to a top rear position. Due to this configuration of the tightening lever (or swivel arm 42) in accordance with the present invention, it is possible to open the binding as a whole very easily. At the same time, it is, however, ensured that the binding cannot be released by an automatic actuation of the tightening or closing mechanism while cross-country skiing. It is preferred that the slot 53 includes an angle $\alpha$ with the vertical of about 15° to 25°.

Figure 9:
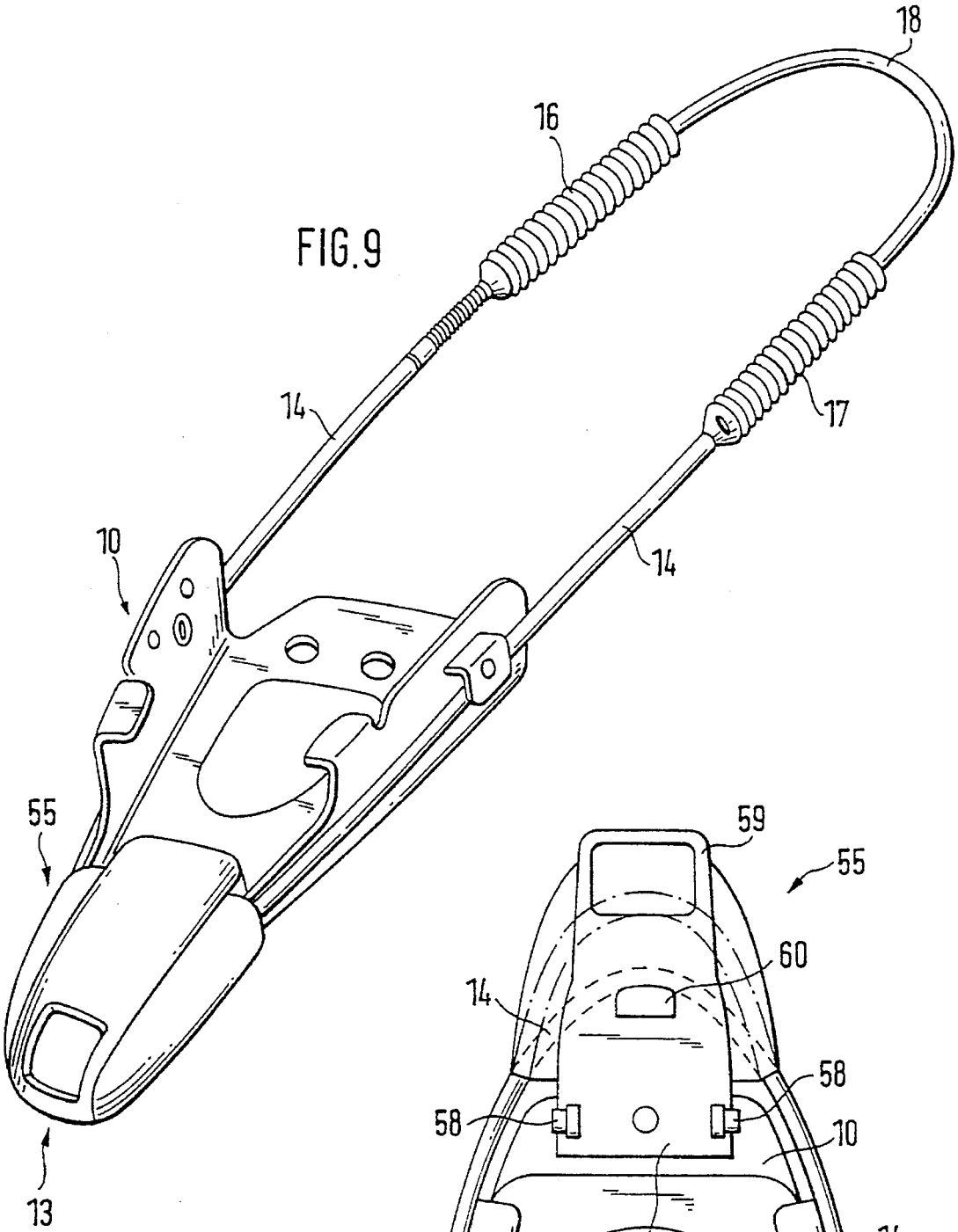
FIG. 9 is a schematic/perspective view of another cross-country ski binding according to the invention.
Figure 12:
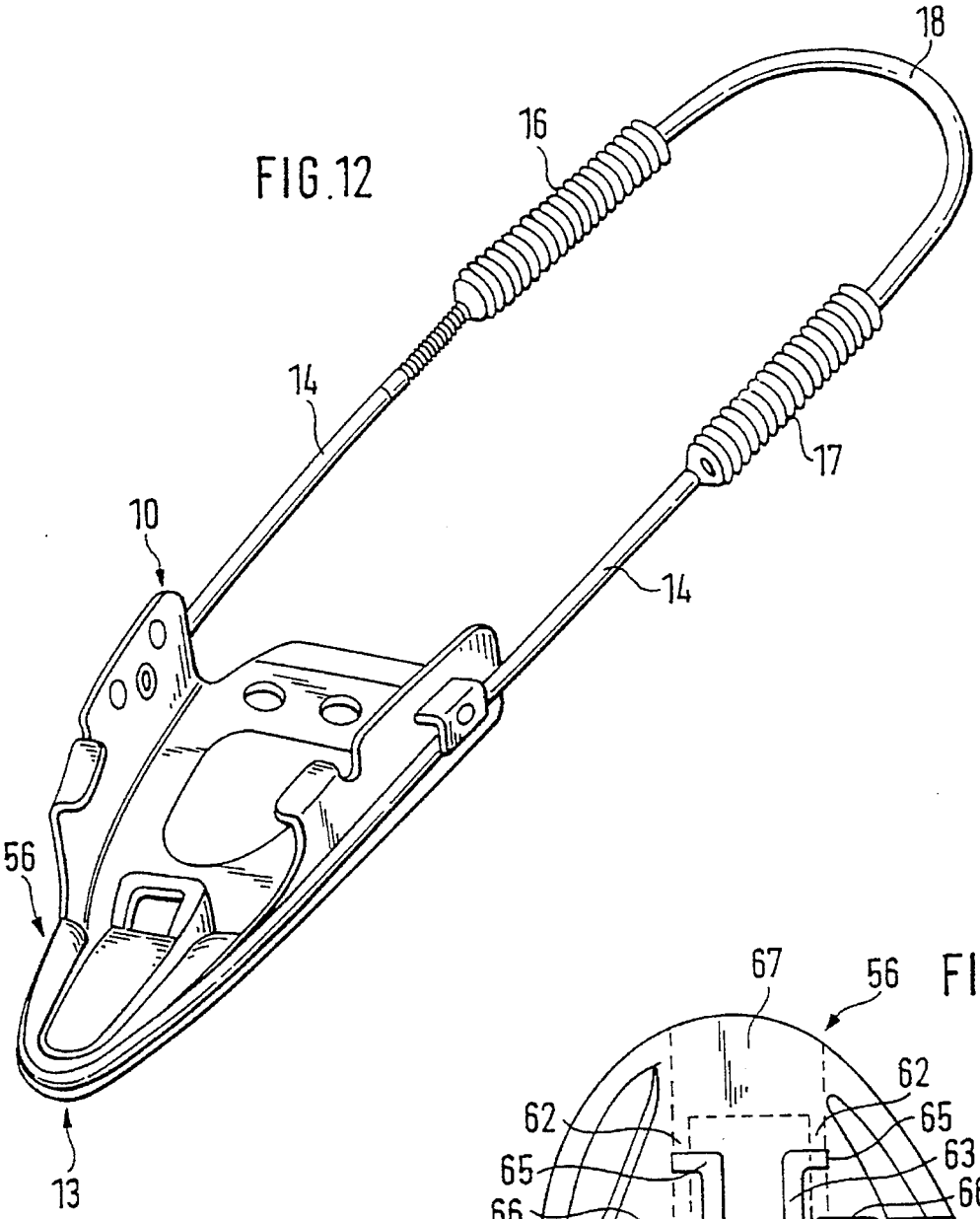
FIG. 12 is a schematic/perspective view of a further cross-country ski binding designed in accordance with the invention.

FIGS. 9 and 12 illustrate two further embodiments of cross-country ski bindings in accordance with the present invention, each comprising a toe iron 10, a tension cable 14, tension springs 16, 17 and a part 18 of the tension cable 14, to be passed around the heel of the boot (not illustrated) corresponding to the binding according to FIG. 1. With these two embodiments of a binding, the tensioning mechanism 13 is respectively constituted by a tightening lever 55 or 56, which is disposed in front of the toe iron 10 and acts directly on the tension cable 14. Each tightening lever 55 and 56 may be moved in a vertical plane and adopts an over-center position in the tensioned or closed position of the binding.

Figure 10:
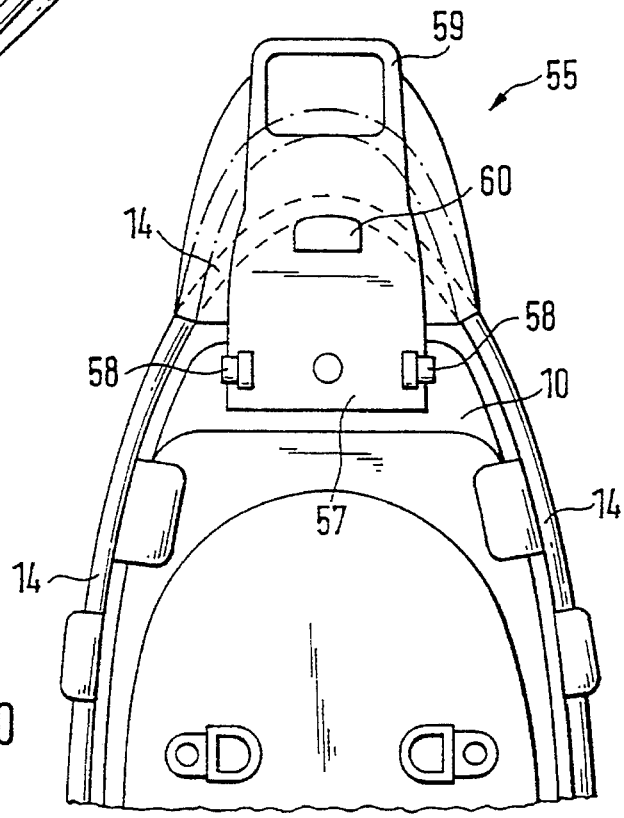
FIG. 10 is a top plan view of the tensioning mechanism according to the invention of the binding of FIG. 9 in conjunction with ski boot and tension cable partially broken away.

The tightening lever 55 according to FIGS. 9 to 11, which is substantially elongated, extends in longitudinal direction of the binding or the ski boot. With its one end 57, which faces the non-illustrated ski boot, the tightening lever 55 is pivoted to the toe iron 10, for instance, by means of two bolts 58 or the like which extend transversely to the longitudinal direction of the tightening lever 55. The other end 59 of the lever 55, which is remote from the ski boot, is used as an actuating member by the cross-country skier.

Furthermore, a tension element 60 is rotatably mounted on the tightening lever 55 to be brought into engagement with the tension cable 14. The tension element may be provided in the vicinity of its end facing the toe iron 10 with one or plural cross-bores longitudinally spaced from each other through which the tension cable 14 is passed so that it is captively held. The tension element 60 may also be provided with a plurality of longitudinally serially arranged fastening elements in the vicinity of its end facing the toe iron 10 into which fastening elements the tension cable 14 may be hooked in accordance with its desired effective length. The cross-bores or hooks, all of which are provided longitudinally in series along the tension element 60, function to provide for coarse adjustment of the tension cable 14.

Figure 11A:
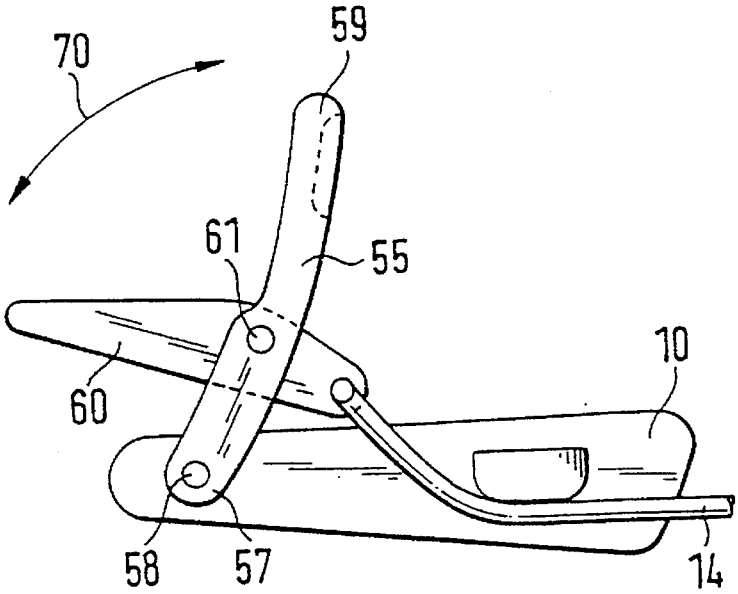
FIG. 11 A and B are schematic side views of the tensioning mechanism according to the invention as shown in FIGS. 9 and 10 in the open position and in the tensioned or closed position of the binding with the tension cable broken away.
Figure 11B:
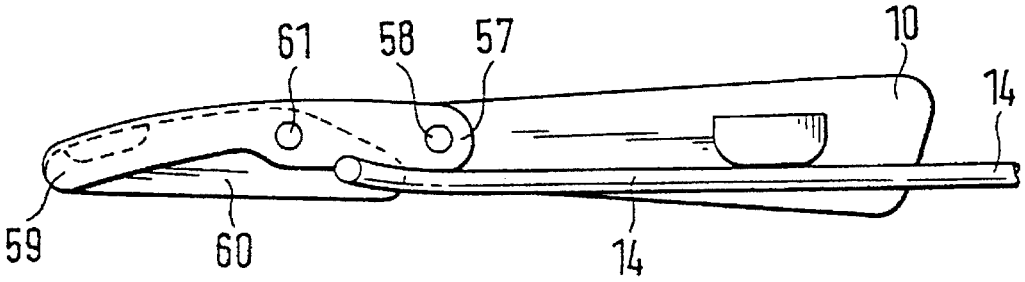

The tension element 60 in FIGS. 11A and 11B is connected to the tightening lever 55 through a pivot 61 in the form of a bolt or the like. The pivot 61 of the tension element 60 is disposed at the tightening lever 55 at approximately the same distance from each end 57, 59 of the tightening lever 55. In order to attain an over-center position, the tension cable 14 with the tension element 60, i.e. with the end thereof which faces the toe iron 10 and to which the tension cable 14 is attached, lies between the ski top, on the one hand, and the two pivots 58, 61 of tightening lever 55 and tension element 60, on the other hand, in the tightened or closed position of the binding (cf. especially FIG. 11B).

Figure 13:
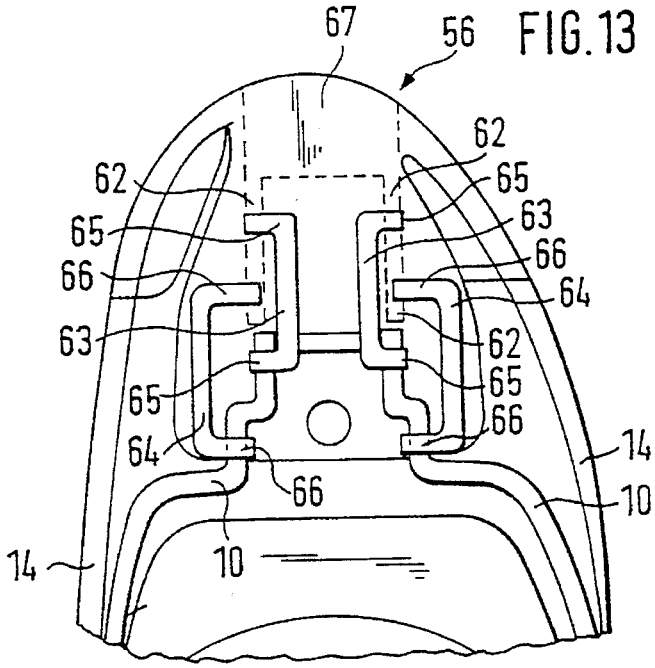
FIG. 13 is a top plan view showing the tensioning mechanism according to the invention of the binding shown in FIG. 12 in combination with a ski boot and tension cable partially broken away.

The tensioning mechanism shown in FIGS. 12 to 14 comprises a tightening lever 56 which is connected to the toe iron 10 by way of two respective swivel arms 63, 64 provided on either side 62 thereof. The two swivel arms 63, 64, which are respectively mounted on either side 62 of the tightening lever 56, are disposed to extend substantially in parallel with each other. According to FIG. 13, each swivel arm 63, 64 is approximately C-shaped. The two swivel arms 63, 64 provided on either side 62 of the tightening lever 56 are displaced relative to each other in longitudinal direction of the tightening lever 56, the ends 65, 66 thereof each extending substantially transversely to the longitudinal direction of the tightening lever 56 and in opposition to each other. In this way, the two laterally disposed swivel arms 65 interconnect the tightening lever 56 and the toe iron 10 on the outside, while the two laterally disposed swivel arms 63 do so on the inside. In this respect, the two ends 65, 66 of each swivel arm 63, 64 are rotatably mounted both in the tightening lever 56 and in the toe iron 10.

Moreover, the tightening lever 56 at its one end 67, which faces away from the toe iron 10, is provided with end recesses such as an arcuate groove 68 or the like in which the tension cable 14 is engaged to be securely retained therein. The other end 69 of the tightening lever 56, which faces the toe iron 10, is used as an actuating member by the cross-country skier. In the tightened or closed position of the binding, the tension cable 14 lies above the top of the ski, on the one hand, and on the other hand beneath at least one of the ends 65, 66 of the swivel arms 63, 64 provided on the tightening lever 56, said ends 65, 66 serving as pivots. Thereby a so-called over-center position is achieved.

Figure 14A:
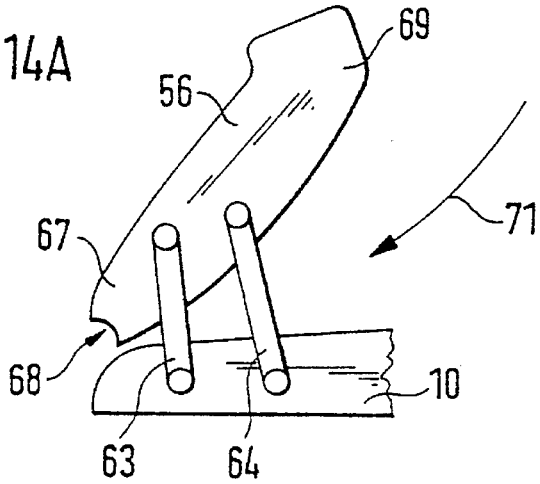
FIG. 14 A to C are schematic side views of the tensioning mechanism according to the invention as shown in FIGS. 12 and 13 illustrated in the open position, in an intermediate position, and in a tensioned or closed position of the binding without tension cable.
Figure 14B:
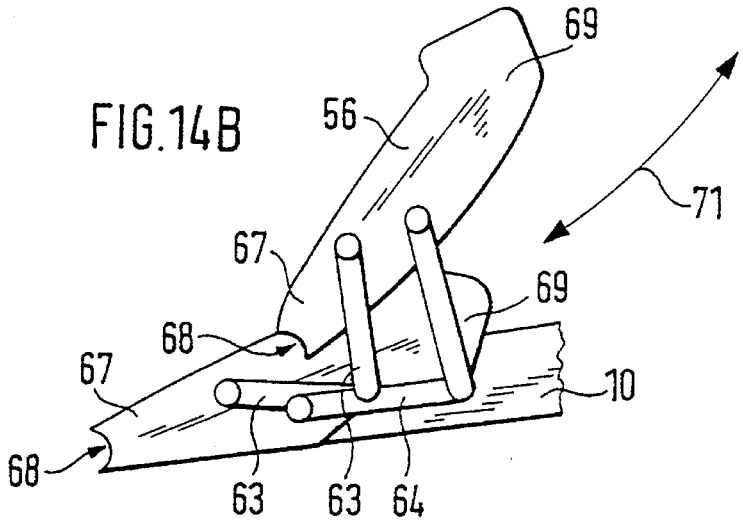
Figure 14C:
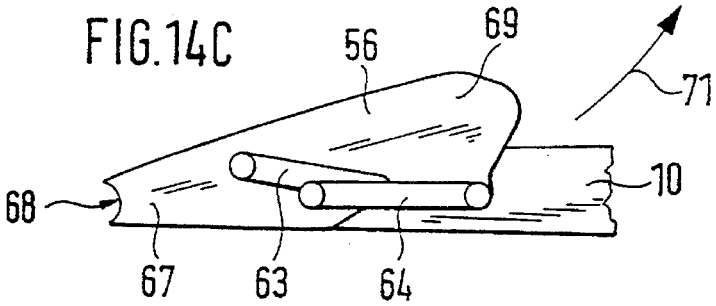

Whereas opening or closing of the binding according to FIGS. 9 to 11 is effected by a swivel movement of the tightening lever 55 with the tension element 60 connected thereto about the pivot 58 in the direction of the arrow 70 (see FIGS. 11A and 11B), opening and closing of the binding shown in FIGS. 12 to 14 is effected by a superimpose rotational or displacing movement of the tightening lever 56 in the direction of the arrow 71 (see FIGS. 14A to 14C).

Figure 15:
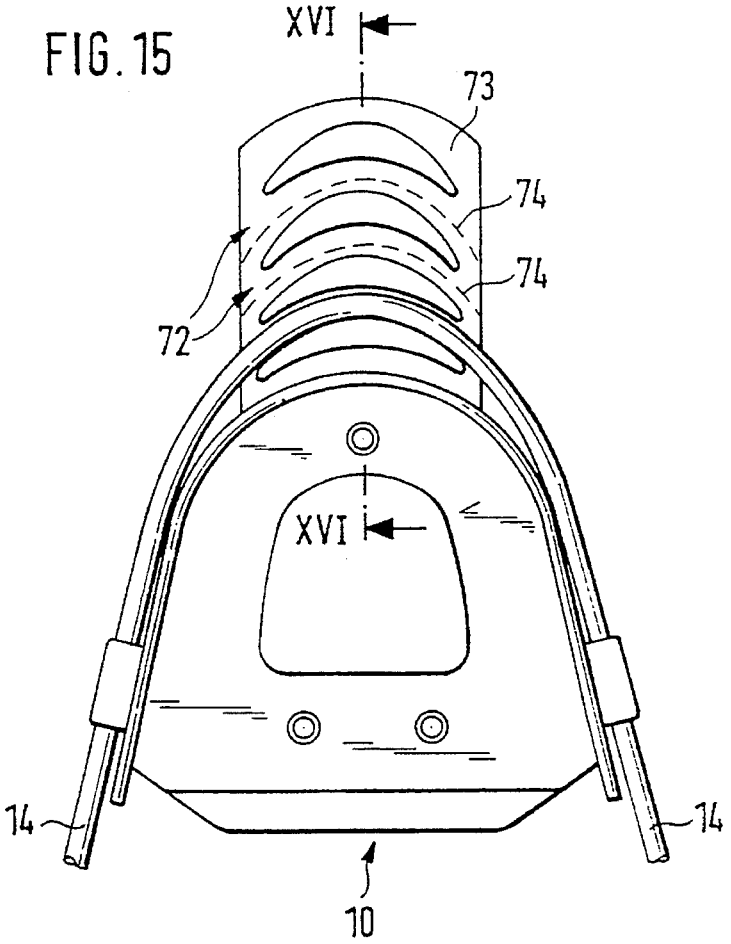
FIG. 15 is a top plan view of an embodiment of a toe iron configured in accordance with the invention.
Figure 16:
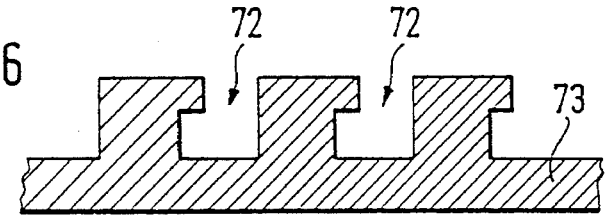
FIG. 16 is a partial longitudinal section in the area of the toe iron illustrated in FIG. 15 along the line XVI—XVI.
Figure 17:
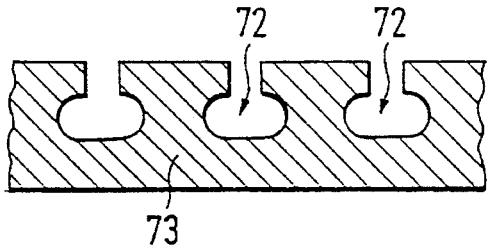
FIG. 17 is a partial longitudinal section in the region of another embodiment of a toe iron in accordance with FIG. 16.

For a coarse adjustment of the effective length of the tension cable 14, at least two respective arcuate grooves 72 are provided in front of the toe iron 10 in FIG. 15 or on the front-side tensioning mechanism (see FIG. 10), respectively, into which grooves the tension cable 14 may be placed or hooked or especially latched from above. The arcuate grooves 72 may be formed in a separate plastic member 73 and in accordance with the desired number they may be severed at predetermined breaking points 74 such as dividing lines, perforations or the like prior to mounting on the ski top. Thereafter, the plastic member 73 which is chosen to have appropriate size, i.e. which is provided with the appropriate number of grooves, may be secured to the ski top by adhesion, screws or the like. FIGS. 16 and 17 illustrate two possible, mutually different profiles to be used for the grooves 72 formed in the plastic member 73.

All of the features disclosed in the present application papers are claimed as being essential to the invention insofar as they are novel over the prior art both individually and in combination.

We claim:

1. A cross-country ski binding for supporting a ski boot having a sole with a boot toe and a boot heel and said boot heel has a lowered position for engaging the ski, comprising a toe iron (10) which is mounted on the top of a ski and includes cheeks (11) and sole catches (12) for accommodating and supporting the boot toe and thereby the ski boot against sideways, forwardly and upwardly directed forces, said toe iron having attachment means for immovably securing the toe iron to the ski, a tension cable unit (14) adapted to be coupled to the toe iron and to be passed about the heel of [the] a ski boot, means (15) associated with said tension cable unit for varying the effective length of the cable, said tension cable unit including a tension spring unit (16, 17) and a relatively solid and rigid bracket having a first end and a second end, a tensioning mechanism (13) coupled to the tension cable unit (14) for securing the boot toe to the toe iron (10) such that during cross-country skiing the boot heel of the skier is adapted to be raised from the lowered position from the ski top with the boot toe fixed within said toe iron and said boot heel resiliently urged to the lowered position by said tension cable, said tensioning mechanism (13) comprising a tightening lever unit (19) being pivotally mounted on said bracket (18) of said tension cable unit (14) and operable to extend said tension cable unit longitudinally of said ski against the action of said spring unit (16, 17) in moving to the lowered position, said tightening lever having a pivot axis (20) parallel to the portion (18) of the tension cable unit (14), wherein said tension spring (16, 17) includes a first spring member (16) and a second spring member (17), said first and second tension spring members each having a first end and a second end, said first end of said first spring member connected to the first end of the rigid bracket (18), said first end of said second spring connected to the second end of said bracket (18), and said spring members each having said second end, said second end of said first spring member including an internally threaded portion, said cable unit having a cable member with a screw bolt (25) connected to said first cable connecting end (24) of the tension cable unit (14) and threaded into said threaded portion to adjust the length of the cable member, said second cable connecting end (27) of the tension cable (14) includes an enlarged member (28) having a connecting piece (26) and said second end of said second spring member being coupled to said enlarged member, and at least one spacer sleeve (29, 30) mounted on the tension cable (14) between the second connecting piece (26) and the enlarged member, and a retaining washer (31) mounted in front of said enlarged member (28) on the second connecting end (27) of the tension cable.

2. The binding of claim 1, wherein said retaining washer (31) includes a lateral cut-out having a width corresponding to the diameter of the tension cable (14) and smaller than the diameter of the enlarged member (28), whereby the retaining washer (31) can be pushed sideways onto the tension cable for positioning the washer in front of the tension cable enlarged member (28).

3. A cross-country ski binding comprising a toe iron having at least one attachment element for securing the toe iron to a ski, comprising a tension cable adapted to be coupled to said toe iron and having a member adapted to pass about the heel of a ski boot, an adjustable unit connected to said tension cable for varying the effective length thereof, said adjustable unit including a tension spring having a first end connected to said member and having a second end, an outer member secured to said second end and movably mounted on said tension cable, said cable extending into the tension spring and including a stop unit secured to the cable within said spring, at least one spacer member adapted to be removably mounted on said cable within said tension spring between said outer member and said stop unit, said stop unit includes a stop member secured to said cable and a retaining member releasably secured to the cable between the stop member and said spacer members, said spacer members being slidable on said stop member, and said retaining member being a washer having a slot fitting over the cable adjacent said stop member.

4. The ski binding of claim 3, wherein said washer is a tubular member having an end wall, said tubular member being axially slidable over said stop member and said end wall having a slot fitting over the cable adjacent the stop member.

* * * * *